US007263760B2

(12) United States Patent
Peterson et al.

(10) Patent No.: US 7,263,760 B2
(45) Date of Patent: Sep. 4, 2007

(54) METHOD FOR MAKING A SLOW-WAVE RIDGE WAVEGUIDE STRUCTURE

(76) Inventors: Kent E. Peterson, 624 Claridge Cir., Hoffman Estates, IL (US) 60194; Delfin Q. Nacilla, 3751 Winding Trail La., Hoffman Estates, IL (US) 60195; Jeffrey B. Barner, 924 Mockingbird Dr., Antioch, IL (US) 60002

( * ) Notice: Subject to any disclaimer, the term of this patent is extended or adjusted under 35 U.S.C. 154(b) by 0 days.

(21) Appl. No.: 11/290,030

(22) Filed: Nov. 30, 2005

(65) Prior Publication Data

US 2006/0077021 A1 Apr. 13, 2006

Related U.S. Application Data

(62) Division of application No. 10/756,858, filed on Jan. 14, 2004, now Pat. No. 7,023,302.

(51) Int. Cl.
*H01P 11/00* (2006.01)
*H01Q 13/00* (2006.01)

(52) U.S. Cl. ..... 29/600; 29/825; 29/592.1; 333/208; 343/909

(58) Field of Classification Search ..... 29/600–602.1, 29/825, 830–831, 846–847; 333/208–210, 333/238–239, 157, 248; 372/96, 45.01; 438/32; 343/700 MS, 909
See application file for complete search history.

(56) References Cited

U.S. PATENT DOCUMENTS 2,943,280 A 6/1960 Brill
3,370,256 A * 2/1968 Baur et al. ..... 333/156
3,597,710 A 8/1971 Levy
4,646,039 A 2/1987 Saad
4,675,631 A 6/1987 Waggett
5,256,990 A 10/1993 Young
5,426,399 A * 6/1995 Matsubayashi et al. ..... 333/1
6,000,120 A * 12/1999 Arledge et al. ..... 29/600
6,118,978 A 9/2000 Ihmels
6,232,853 B1 5/2001 Goulouev
6,278,720 B1 * 8/2001 Lee et al. ..... 372/46.01

(Continued)

OTHER PUBLICATIONS

George Goussetis & Djuradj Budmir, Novel Periodically Loaded E-Plane Filters, IEEE Microwave & Wireless Components Letters, Jun. 2003, 3 pgs. vol. 13, No. 6.

*Primary Examiner*—Minh Trinh
(74) *Attorney, Agent, or Firm*—Stetina Brunda Garred & Brucker

(57) ABSTRACT

A method of fabricating a ridge waveguide filter having a slow-wave structure. The ridge waveguide is formed of a conductive sidewall-from metallic materials and may be in the form of a hollow tube, such as a rectangular hollow tube or a circular hollow tube, for example. The method comprises the steps of: forming a conductive body portion of an elongate hollow tube, wherein the body portion has an open top a bottom wall, two opposing side walls and an open top; providing a substrate having a top surface onto which a plurality of photoresist layers are formed; etching the top surface of the substrate to form a plurality of trenches in the substrate; plating the etched substrate surface with a layer of conductive material; and attaching the etched substrate to the conductive body portion to cover the open top of the conductive body portion.

4 Claims, 6 Drawing Sheets

U.S. PATENT DOCUMENTS 6,476,696 B1 11/2002 Mack
6,642,075 B2 * 11/2003 Takiguchi ..... 438/32
6,657,520 B2 12/2003 Mack et al.
7,023,302 B2 * 4/2006 Peterson et al. ..... 333/208
7,084,058 B2 * 8/2006 Ahn et al. ..... 438/652

* cited by examiner

METHOD FOR MAKING A SLOW-WAVE RIDGE WAVEGUIDE STRUCTURE

CROSS-REFERENCE TO RELATED APPLICATIONS

The present application is a divisional application of U.S. application Ser. No. 10,756,858 entitled "SLOW-WAVE STRUCTURE FOR RIDGE WAVEGUIDE" filed Jan. 14, 2004 now U.S. Pat. No. 7,023,302.

STATEMENT RE: FEDERALLY SPONSORED RESEARCH/DEVELOPMENT

Not Applicable

BACKGROUND OF THE INVENTION

The present invention relates in general to a waveguide filter, and more particularly, to a ridge waveguide filter having a slow-wave structure.

Waveguide filters have been widely known to provide outstanding performance at microwave frequencies compared to other technologies such as microstrips, striplines or even coax transmission lines. Depending on the configurations and dimensions, low-pass, high-pass, and band-pass waveguide filters have been developed to separate the various frequency components of a complex wave. FIG. 1 shows a conventional rectangular waveguide. The rectangular waveguide is typically a hollow metallic tube with a rectangular cross-section. According to IRE standards, the coordinate system as shown in FIG. 1 includes the x direction taken as the longer transverse dimension, the y direction taken as the shorter transverse dimension, and the z direction taken as the longitudinal dimension. The conducting walls of the waveguide confine electromagnetic fields and thereby guide the electromagnetic wave. As known in the art, the rectangular waveguide is normally very bulky and costly. Although the lately developed micro-machine technique seems to resolve the cost issue, the dimension of the rectangular waveguide is still too large to be useful.

To resolve the size issue, ridge waveguides have been proposed by introducing single ridge or multiple ridges into the rectangular waveguides. The introduction of a ridge loads the waveguide with a shunt capacitance and therefore reduces the characteristic impedance of the waveguide. As a consequence, the cross-sectional area required for operation at a certain frequency is reduced compared to the rectangular waveguide, but the decreased impedance leads to two deleterious effects, including increased loss (degraded performance) due to the increased current that must flow through the conductive walls, and the limited bandwidth obtainable in coupling structures connecting to the ridge waveguide.

George Goussetis discloses a periodically loaded E-plane filter in IEEE Microwave and wireless components letters, Vol. 13, No. 6, June 2003. The E-plane filter is formed by loading periodically reactive obstacles in form of ridges in a conventional rectangular waveguide. Such E-plane filters, though providing a slow-wave structure, does not resolve the cross-sectional size issue of the rectangular waveguides, and do not take advantage of the increased impedance.

Therefore, there is a substantial need to provide a waveguide filter structure that includes a slow-wave structure and has a reduced size. Further, the characteristic impedance of such a waveguide filter will not be reduced because of size reduction.

BRIEF SUMMARY OF THE INVENTION

The present invention provides a ridge waveguide filter having a slow-wave structure. The ridge waveguide comprises an elongate hollow tube defined by a conductive sidewall. At least a first part of the conductive sidewall periodically protrudes into the hollow tube along an elongate direction of the hollow tube to form a plurality of ridges in the hollow tube. Preferably, the sidewall is fabricated from metallic materials. If made from a non-conductive material, the material should be metallized on the interior surfaces. The hollow tube includes a rectangular hollow tube or a circular hollow tube, for example. The ridges are equally spaced from and parallel with each other, and each of the ridges has a bottom surface parallel with a second part of the conductive sidewall. The second part of the conductive sidewall is opposite to the first part of the conductive sidewall.

The present invention further provides a ridge waveguide filter having a slow-wave structure which comprises an elongate hollow tube defined by a conductive sidewall, at least one ridge protruding from the conductive sidewall into the hollow tube and extending along an elongate direction of the hollow tube, and a plurality of trenches formed in the ridge along the elongate direction. The conductive sidewall includes either a rectangular cross section or a circular cross section, for example. The trenches may have a depth the same as the height of the ridge. The trenches are parallel to each other and equally spaced from each other.

The present invention further provides a method of forming a ridge waveguide having a slow-wave structure. A body portion of an elongate hollow tube is formed, and the body portion has an open top. A planar plate having a first surface and a second surface opposite to the first surface is provided. The first surface is processed by micro-machine technique to form a ridge. The ridge is recessed from the first surface and protruding from the second surface. The second surface is further processed by micro-machine technique to form a plurality of trenches recessed from a top surface of the ridge. The open top of the body portion is covered by attaching the planar plate to the body portion, while the second surface of the planar plate faces the body portion.

The present invention further provides an alternative method of forming the ridge waveguide filter. The method comprises the following steps. An elongate body of an easily etched material, such as Silicon, is provided. After the appropriate photolithographic patterning, a shallow etch is made, to form what will become the gap between a ridge and the opposite side. Lithographic patterning is again applied, and since the first etch was shallow, the second pattern is able to conform to the previously etched surface. A second deep etch, perhaps made with the reactive ion etch (RIE) technique, forms the sides of the waveguide and the notches in the ridge. This piece is then metallized and a conductive plate is attached to it in such a way as to form the bottom of the waveguide.

The present invention further provides a method of maintaining a characteristic impedance of and reducing a size of a waveguide operating at a certain frequency. The method comprises the following steps. A top wall portion of the waveguide is processed to form a ridge projecting into the waveguide. The ridge extends along an elongate direction of the waveguide. The ridge is partitioned into a plurality of small ridges arranged in parallel and separated with each other by a gap, so as to effectively introduce a plurality of inductances between the ridge segments. The ridge segments themselves capacitively couple to a bottom wall of the waveguide, such that the ridge segments and the gaps form a transmission line operating in such a way as to slow a wave propagating down the waveguide.

BRIEF DESCRIPTION OF THE DRAWINGS

These, as well as other features of the present invention, will become apparent upon reference to the drawings wherein.

DETAILED DESCRIPTION OF THE INVENTION

Figure 3:
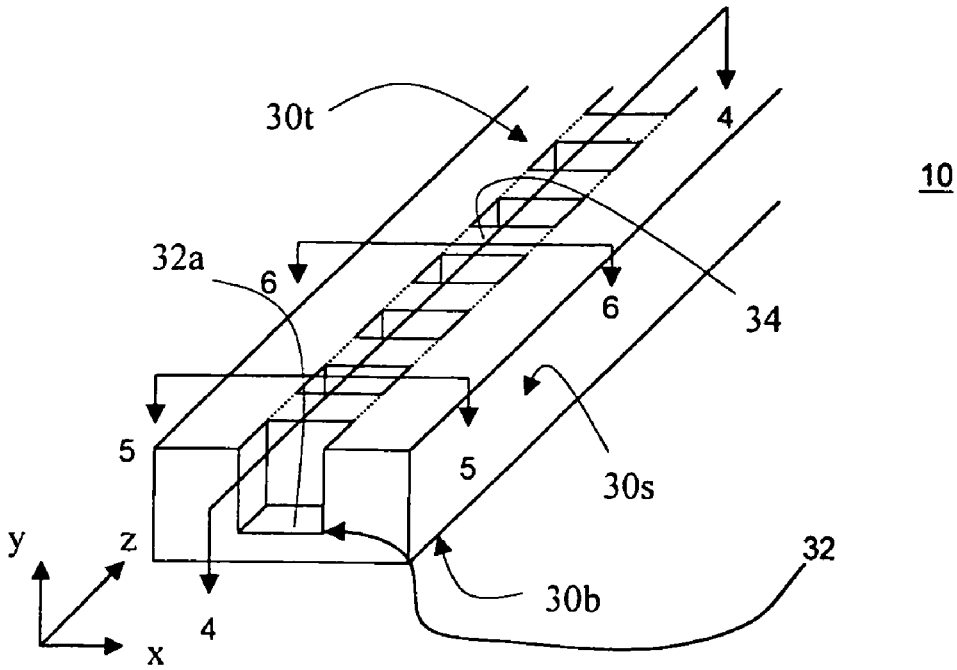
FIG. 3 schematically shows a perspective view of a ridge waveguide with a slow-wave structure provided by the present invention.
Figure 4:
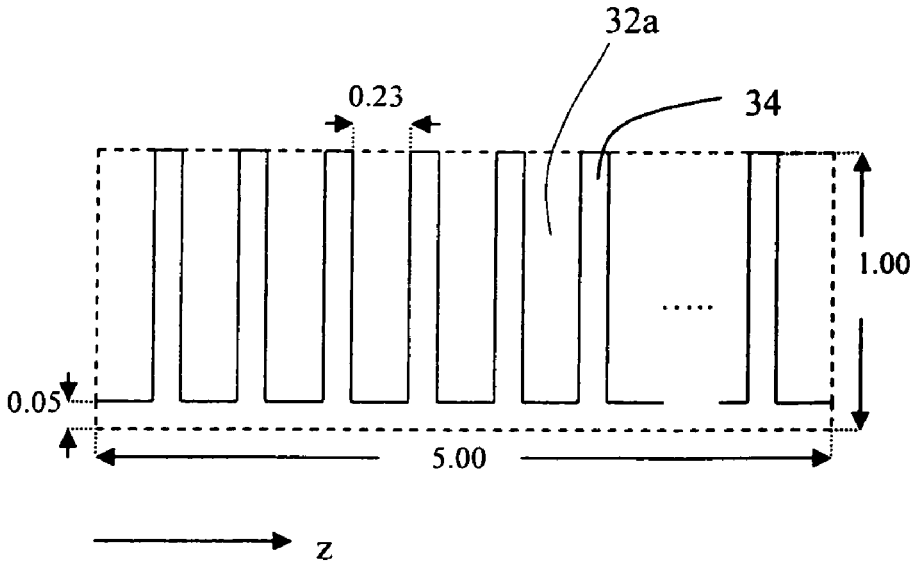
FIG. 4 shows a cross-sectional view of the ridge waveguide along line 4-4 as shown in FIG. 3.

As mentioned above, ridge waveguides have been proposed as a useful modification to resolve the size issue of the rectangular waveguides. To further resolve the reduced characteristic impedance problem of the ridge waveguide and to adequately reduce the phase velocity of the wave propagated within the ridge waveguide, the present invention provides a ridge waveguide having a slow-wave structure 10 as shown in FIG. 3. The ridge waveguide has a hollow rectangular tube with a top wall 30*t*, two opposing side walls 30*s* and a bottom wall 30*b*. Preferably, the top, side and bottom walls 30*t*, 30*s* and 30*b* are fabricated from conductive or metallic materials, and the tube is filled with air. According to IRE standards, the coordination system as shown in FIG. 4 includes an x direction taken as the longer transverse dimension, a y direction taken as the shorter transverse dimension, and a z direction taken as the longitudinal dimension, along which the wave propagates within the ridge waveguide. Along the z direction, the central portion of the top wall 30*t* is recessed to form an elongate ridge 32 protruding downwardly into the tube. The ridge 32 has two side surfaces parallel with the side walls 30*s* and a bottom surface parallel with the bottom wall 30*b*. The ridge waveguide further comprises a plurality of trenches 34 formed in the ridge 32. In this embodiment, as the hollow tube has a rectangular profile, the trenches 34 are also configured into rectangular shape with a depth the same as the height of the ridge 32. As shown in FIG. 3, the formation of the trenches 34 partitions the ridges 32 into a plurality of small ridges 32*a* arranged in parallel along the z direction. It will be appreciated that in addition to the rectangular tube profile, the ridge waveguide can also be configured with other profiles such as cylindrical tube profile. When the ridge waveguide is configured into a structure other than a hollow rectangular tube, the shapes of the ridge 32 and the trenches 34 may also be altered. Further, though the ridge waveguide as shown in FIG. 4 includes only one ridge 32, the present invention can also be applied to dual-ridge waveguide or multiple-ridge waveguide without exceeding the scope and spirit of the present invention.

Figure 5:
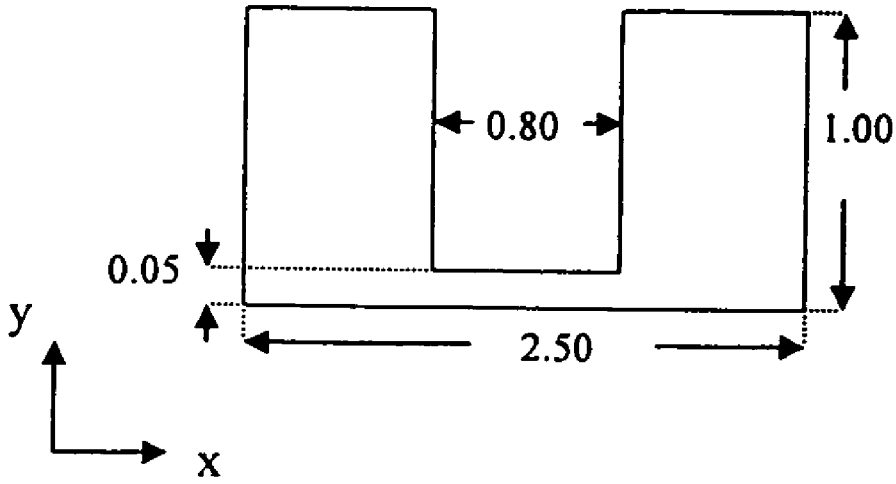
FIG. 5 shows a cross-sectional view of the ridge waveguide along line 5-5 as shown in FIG. 3.
Figure 6:
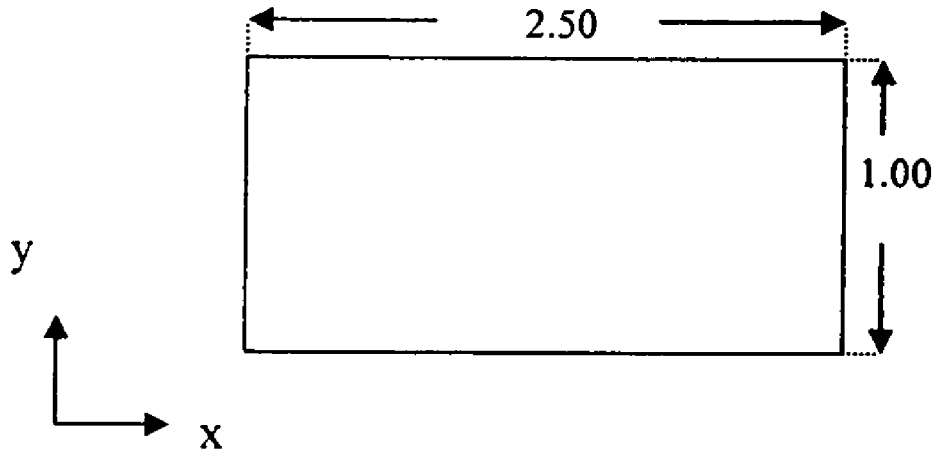
FIG. 6 shows a cross-sectional view of the ridge waveguide along line 6-6 as shown in FIG. 3.

FIG. 4 shows a cross sectional view of the ridge waveguide along the longitudinal dimension. In FIG. 4, the side wall 30*t* is illustrated in dash-line, and the ridge 32 is illustrated in solid line. As shown in FIGS. 3 and 4, the ridge 32 is sandwiched by the side walls 30*s* and processed, preferably by micro-machine process, to form the trenches 34 therein. The micro-machine process will be introduced in details later in this specification. As the trenches 34 are intermittently formed along the ridge 32, the ridge waveguide provides alternate ridged rectangular paths and rectangular paths for a wave propagating through as shown in FIGS. 5 and 6, respectively. That is, when a wave is propagating through the small ridges 32*a*, a ridged path is provided to the wave, and when the wave is propagating though the trenches 34, a rectangular path is provided to such wave.

The width and height of the ridge 32 and the number and width of the trenches 34 formed in the ridge 32 depends on the desired operation frequency. In this embodiment, the width, height and length of the ridge waveguide are 2.5 mm, 1.00 mm and 5.00 mm, and the width and height of the ridge are about 0.80 mm and 0.95 mm. For a ridge waveguide without the slow-wave structure, that is, the trenches 34 intermittently formed in the ridge 32, the characteristic impedance is about 20 Ohms. By introducing sixteen 0.23 mm wide trenches 34 into the ridge 32, the characteristic impedance is increased to about 45 Ohms. Therefore, the power loss of the ridge waveguide having the slow-wave structure is greatly reduced.

Figure 1:
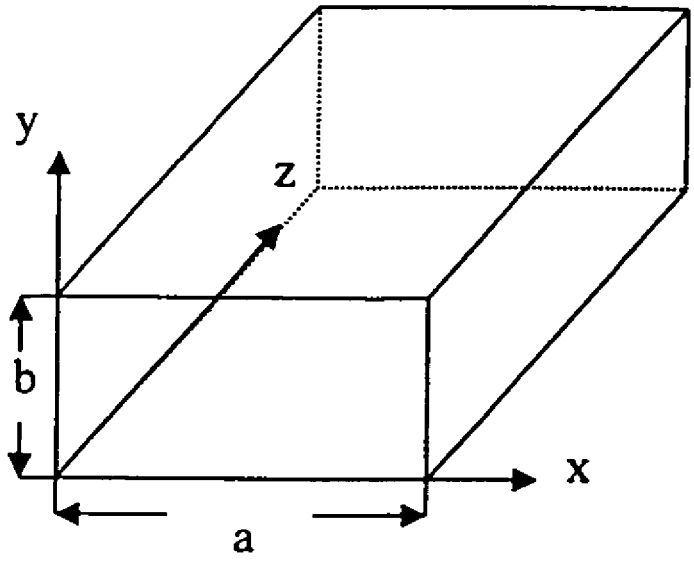
Fig. 1 (Prior Art)
FIG. 1 shows a perspective view of a rectangular waveguide.
Figure 2:
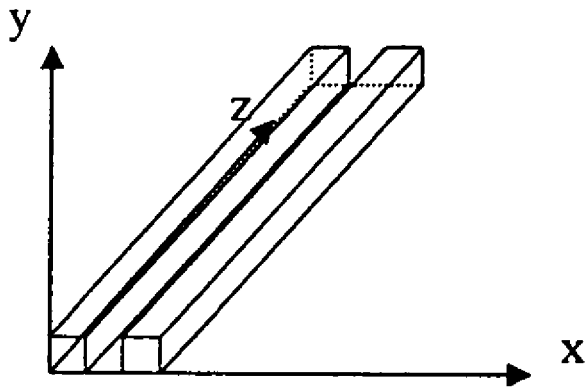
FIG. 2 shows a perspective view of a ridge waveguide.

It is known in the art that when the rectangular waveguide as shown in FIG. 1 confines an electromagnetic wave within the conductive walls thereof, several boundary conditions of an electromagnetic wave are applied to the electromagnetic wave. That is, the tangential components of electric fields and the normal components of magnetic fields of the electromagnetic wave vanish at the walls of the waveguide. Therefore, a cutoff frequency fc as a function of the transverse dimension of rectangular waveguide, that is, a and b, can be derived. Consequently, the characteristic impedance and phase velocity as a function of the cutoff frequency fc can also be determined. When a ridge is introduced in the rectangular waveguide, the boundary conditions of the fields of the electromagnetic wave are modified. The tangential component of electric fields and the normal component of magnetic fields vanish at more positions of the coordinate system compared to those within the rectangular waveguide. Therefore, the cutoff frequency, characteristic impedance and phase velocity are different from those for the rectangular waveguide. In the present invention, as the trenches 34 are formed in the ridge 32, the boundary conditions of the ridge waveguide are only intermittently provided to the electromagnetic wave. As a consequence, the cutoff frequency, the characteristic impedance and the phase velocity are further altered.

Figure 7:
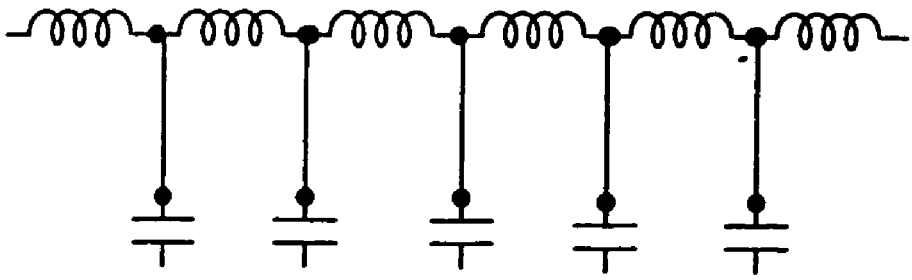
FIG. 7 shows an equivalent circuit of the ridge waveguide as shown in FIG. 3.

As mentioned above, the bottom surface of the ridge 32 and the bottom surface 30*b* of the rectangular waveguide are parallel with each other. As both the bottom surface ridge 32 and the bottom surface 30*b* are fabricated from conductive material, formation of the ridge 32 can thus be modeled as loading a pair of parallel plate capacitances to the waveguide along the elongate direction, that is, the z direction of the waveguide. As the ridge 32 has been partitioned into a plurality of small ridges 32*a* by the trenches 34, this pair of parallel plate capacitances is thus partitioned into a plurality pairs of plate capacitances periodically loaded to the waveguide in parallel. The top surface of trenches 34 interconnecting the small ridges 32*a* provides series inductances between the neighboring pairs of plate capacitances. An equivalent circuit of the ridges 32*a* and the trenches 34 is illustrated as FIG. 7. The characteristic impedance of the ridge waveguide having the slow-wave structure is increased, while the phase velocity is increased by a ratio of about 2.5:1.

Figure 8A:
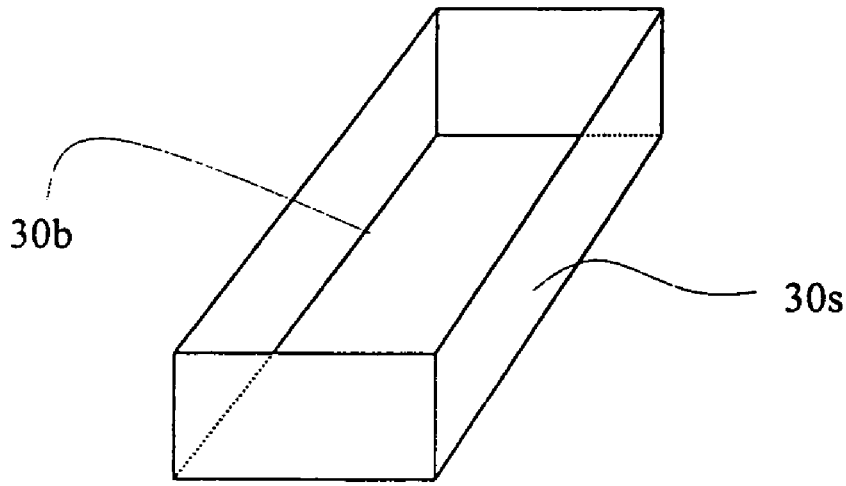
FIG. 8A to 8C shows a fabrication process of the ridge waveguide having a slow structure.
Figure 8B:
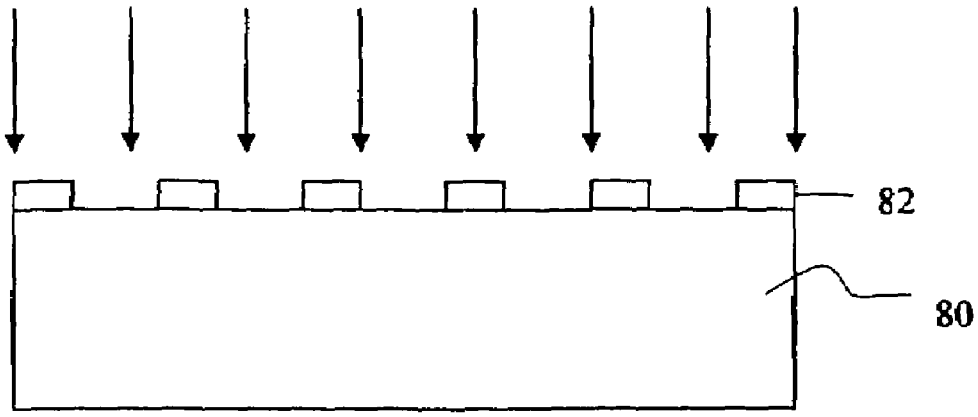
Figure 8C:
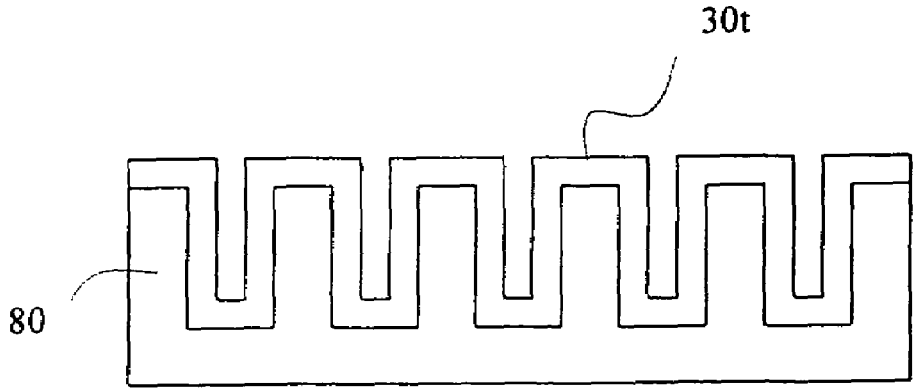
Figure 9:
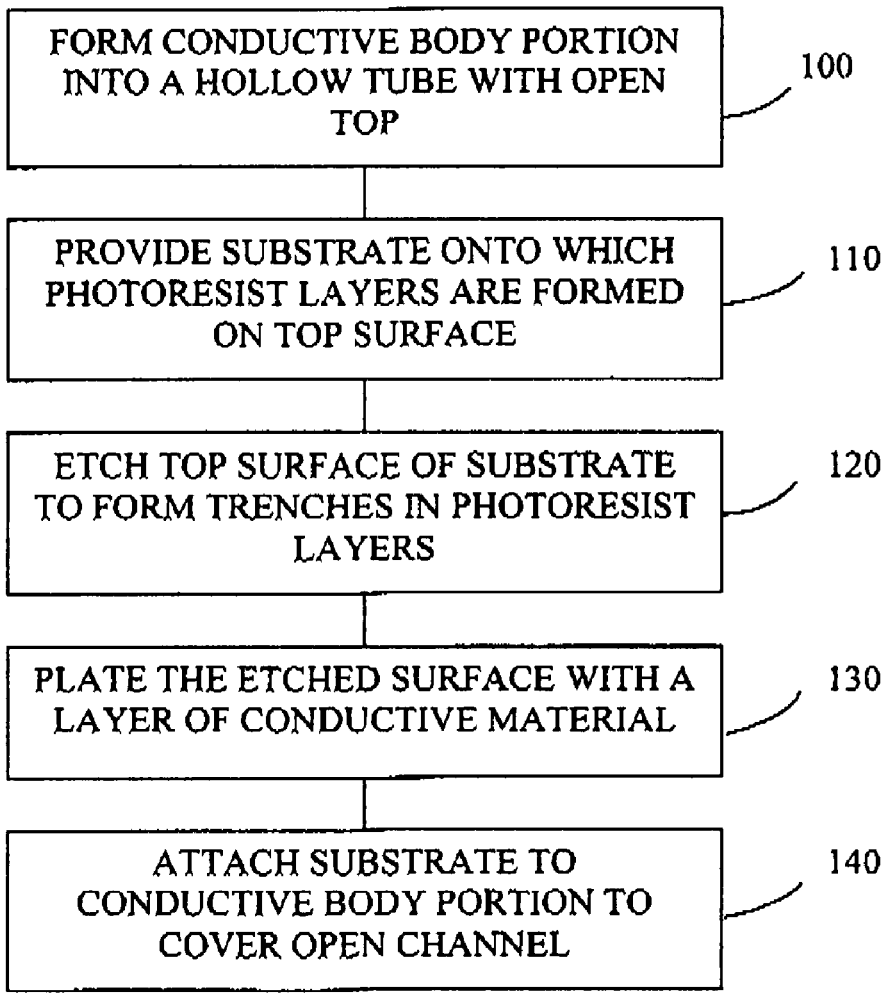
FIG. 9 shows a flow chart of a fabrication process of the ridge waveguide having a slow structure.

Referring to FIGS. 8A to 8C and 9, the fabrication process of the ridge waveguide with a slow structure as provided in the present invention is described. In the example of a ridge waveguide with a rectangular profile, a body portion, including the bottom wall 30*b*, the side walls 30*s*, and an open top is formed, as shown in FIG. 8A at step 100 using a regular machining process. As shown in FIG. 8B, a substrate 80, such as a silicon substrate, is provided, and a plurality of photoresist layers 82 is formed on the top surface of the substrate 80 at step 110. An etching step is then performed on the top surface of the substrate 80 at step 120 to form a plurality of trenches in the substrate 80, as shown in FIG. 3. A layer of conductive material serving as the top wall 30*t* of the ridge waveguide is then plated on the etched top surface of the substrate 80 at step 130. Preferably, the top wall 30*t* is conformal to the surface profile of the etched substrate 80. The top wall 30*t* is then attached to the body portion of the waveguide to the side walls 30*s* to cover the open top thereof at step 140, so as to form the ridge waveguide having the slow structure, which is shown in FIG. 3.

Alternatively, the top wall 30*t* can also be formed by another process including the following steps. A planar plate having a first surface and a second surface opposite to the first surface is provided. The first surface is partially masked and processed to form a ridge. The ridge is recessed from the first surface and protruding from the second surface. The first surface is then unmasked, and the plate is flipped over, such that the ridge is projecting upwardly from the second surface. The ridge is partially masked and processed to form a plurality of trenches recessed therefrom. The plate having the ridge and the notches is then attached to the side walls 30*s* with the second surface facing downwardly to form the ridge waveguide.

This disclosure provides exemplary embodiments of ridge waveguide having a slow-wave structure and a method of fabricating the ridge waveguide. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed is:

1. A method of fabricating a ridge waveguide filter having a slow-wave structure, comprising:

a) forming a conductive body portion of an elongate hollow tube, wherein the body portion has a bottom wall, two opposing side walls and an open top;

b) providing a substrate having a top surface onto which a plurality of photoresist layers are formed;

c) etching the top surface of the substrate to form a plurality of trenches in the photoresist layers of the substrate;

d) plating the etched surface with a layer of conductive material; and e) attaching the substrate to the conductive body portion to cover the open top of the conductive body portion.

2. The method of claim 1, wherein the substrate is a silicon substrate.

3. The method of claim 1, wherein the plurality of trenches are parallel to each other along an elongate direction of the hollow tube.

4. The method of claim 1, wherein step (d) comprises placing the layer of conductive material conformal to an etched surface profile of the substrate.

* * * * *